United States Patent [19]

Ogata et al.

[11] 4,352,227

[45] Oct. 5, 1982

[54] APPARATUS FOR PRODUCING A FINNED TUBE FOR HEAT TRANSFER

[75] Inventors: Masami Ogata; Motoshi Yoshihara, both of Hirakata; Masahira Tada, Osaka, all of Japan

[73] Assignee: Nishiyodo Air Conditioner Co., Ltd., Osaka, Japan

[21] Appl. No.: 167,873

[22] Filed: Jul. 14, 1980

[30] Foreign Application Priority Data

May 20, 1980 [JP] Japan ..... 55-67354

[51] Int. Cl.[3] ..... B21C 37/26

[52] U.S. Cl. ..... 29/33 F; 29/157.3 AH; 29/727; 57/11; 165/184; 228/5.1

[58] Field of Search ..... 140/111, 112; 228/5.1, 228/173 E; 29/33 F, 33 D, 33 T, 157.3 A, 157.3 AH, 727; 113/118 A, 118 B, 118 V; 165/184; 57/6, 9, 11

[56] References Cited

U.S. PATENT DOCUMENTS

| | | | |
|---|---|---|---|
| 3,789,786 | 2/1974 | Wiedenmann et al. | 29/157.3 AH X |
| 3,856,079 | 12/1974 | Geppelt | 165/184 |
| 4,259,771 | 4/1981 | Ogata et al. | 29/157.3 AH X |

*Primary Examiner*—Howard N. Goldberg
*Assistant Examiner*—Fred A. Silverberg
*Attorney, Agent, or Firm*—Blanchard, Flynn, Thiel, Boutell & Tanis

[57] ABSTRACT

An apparatus for producing a wire fin tube for heat transfer which comprises a wire fin forming station, a fin guiding station, a wire fin delivery station, a tube feeding device and a welding device, whereby a plurality of wires are simultaneously shaped into wavy wires which in turn are wound around a tube in the form of plural helices. The fin guiding station is characterized by having at least two different paths of different lengths whereby the wavy wires are wound around the tube in at least two different phases.

7 Claims, 8 Drawing Figures

APPARATUS FOR PRODUCING A FINNED TUBE FOR HEAT TRANSFER

This invention relates to an apparatus for producing a wire fin tube for heat transfer in which wire fins are helically wound around and secured to the surface of a tube body.

Conventional finned tubes for heat transfer, used in a heat exchanger, particularly a condenser, an evaporator or the like for refrigeration machinery, include, for example, an aerofin tube, an Edward (petal-shaped) fin tube, a low fin tube and so forth.

The aerofin tube is likely to cause film condensation on the top surfaces of the fins when it is used for condensation purposes. That is, the condensed liquid film descends gradually and thickens in the lower parts thereof and the condensate eventually forms large drops which fall off the tube. The increase in the thickness of the liquid film, which parameter is inversely proportional to the coefficient of heat conduction, inevitably results in a decrease in the coefficient of heat conduction. Hence, the film condensation phenomenon ultimately diminishes the thermal exchange efficiency of the fins.

The Edward fin tube has a good fixing strength of the fins. However, it has a lower thermal exchange efficiency as compared with the aerofin tube, since it is constructed so that the space surrounded by the arcuate portions of the fins and the surface of the tube body cannot be effectively utilized as a heat exchange area. Furthermore, when this type of fin tube is used in a shell-and-tube type condenser, a dew-like liquid film is produced, which leads to a lowering in the coefficient of heat conduction and accordingly, to a decrease in the coefficient of heat transfer.

The low fin tube, in which the tube surface is fluted by form-rolling processing, requires that the tube body be made of a material having a large radial thickness. Consequently, a large amount of material is required for the production of the low fin tube, which is not desirable from the viewpoint of conserving resources and naturally entails an increase in cost.

Thus, conventional finned tubes have inherent advantages and disadvantages or problems. A wire fin tube has recently attracted attention as a product capable of overcoming the foregoing drawbacks or problems. The present inventors previously proposed this type heat transfer tube.

This type of wire fin tube for heat transfer is formed by winding helically wavy fins on the surface of a heat transfer tube with the arch-shaped portions thereof being upright and then uniting them by welding. Since in this process a plurality of the wavy fins are formed simultaneously by being wound on the surface of the tube body as multiple helixes in a side-by-side parallel relationship, the fins, in most cases, define a required winding angle to the surface with the arch-shaped portions being in side-by-side alignment. As will be seen from FIGS. 7 and 8, in which there are shown respectively the shape of the fins and a configuration pattern of the arch-shaped portions and the bottom or trough portions of the wavy fins, the bottom or trough portions, illustrated as solid circles in FIG. 8, are arranged in a row forming a relative angle ($\theta'$) to the axis of the heat transfer tube. The arch-shaped portions, illustrated as hollow circles in FIG. 8, are ordered in a row adjacent to the bottom portions likewise forming the relative angle ($\theta'$).

For tubes with this fin configuration, the flow of a fluid outside the heat transfer tube is as follows. The arch-shaped portions are arranged close to one another, so that the spaces formed between the arch-shaped portions (1*a*) are narrow and the fluid flowing through the spaces undergoes a large flow resistance. On the other hand, the trough or bottom portions (1*b*) form linear fluid passages extending in one direction where the fluid most readily flows. Thus, so-called localized flow occurs, and the fluid does not flow uniformly on the surface of the heat transfer tube (2). Consequently, the coefficient of thermal conduction outside the tube is not much improved notwithstanding the increase in heat conduction area due to the winding of the wavy fins. Hence, the thermal exchange efficiency, as a whole, is not increased, so that contemplated objectives cannot be attained satisfactorily.

In view of the fact that the wavy fin type of finned tube still remains to be improved, the present invention has been accomplished.

Specifically stated, this invention is characterized in that files of wavy wires are wound around a tube body for heat transfer so as to differ in phase between at least two groups of the files by means of a simple mechanism, whereby the interval between the arch-shaped portions is enlarged as compared with the case of a prior wavy fin tube, and thermal exchange efficiency as a whole is improved by avoiding having the trough or bottom portions extend in one direction in a linear manner.

The invention will be described in greater detail with reference to one example illustrated in the accompanying drawings in which.

Figure 1:
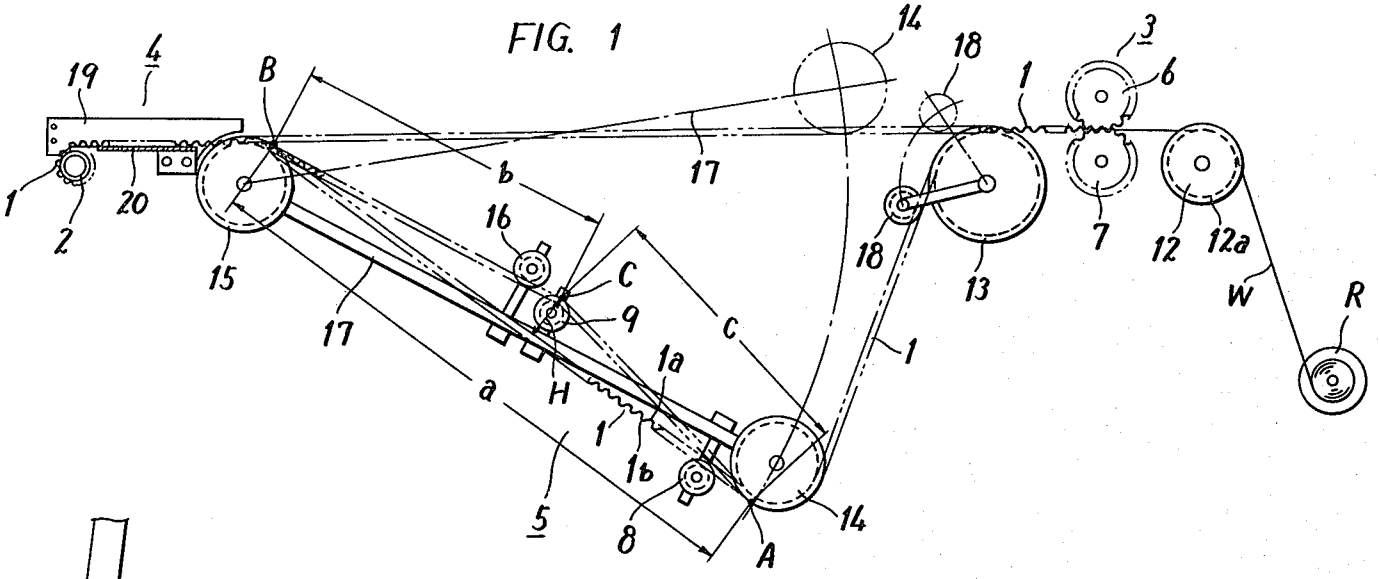
FIG. 1 is a schematic elevational view of one example of the apparatus according to this invention.
Figure 2:
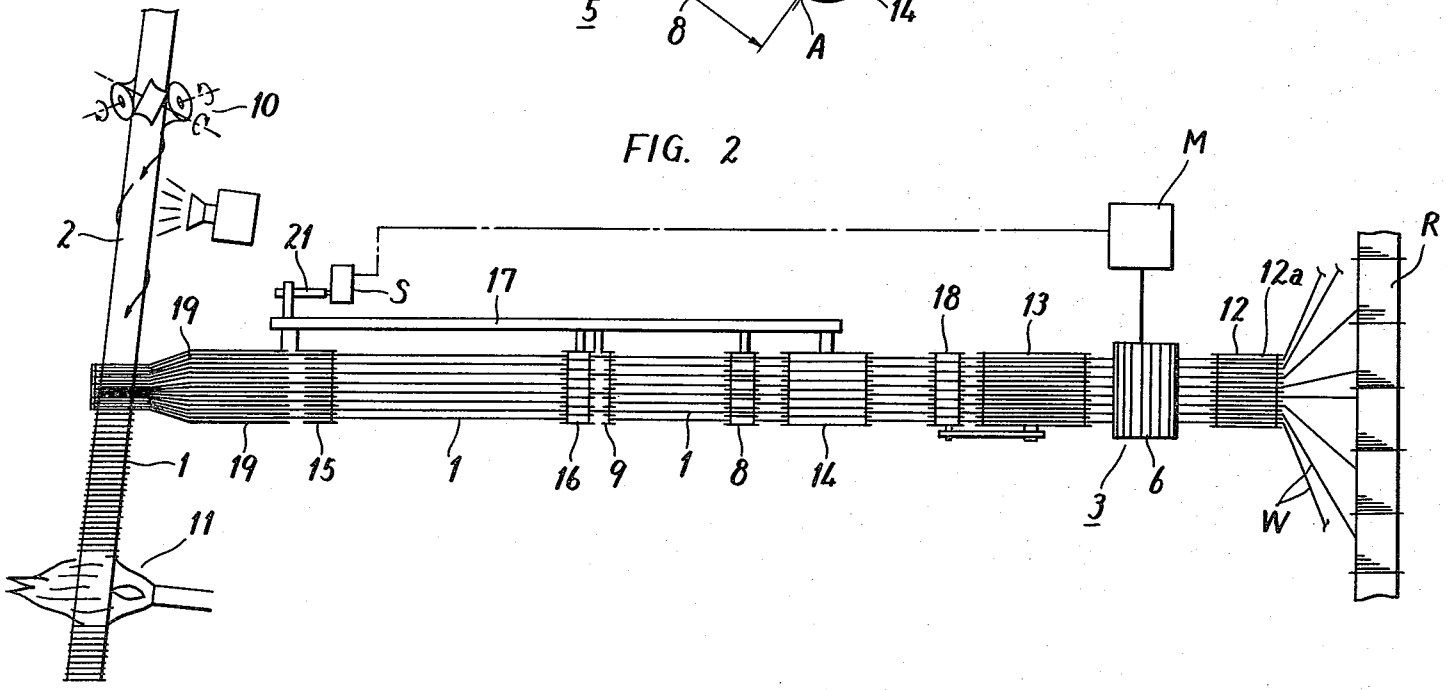
FIG. 2 is a schematic plan view of the apparatus shown in FIG. 1.
Figure 3:
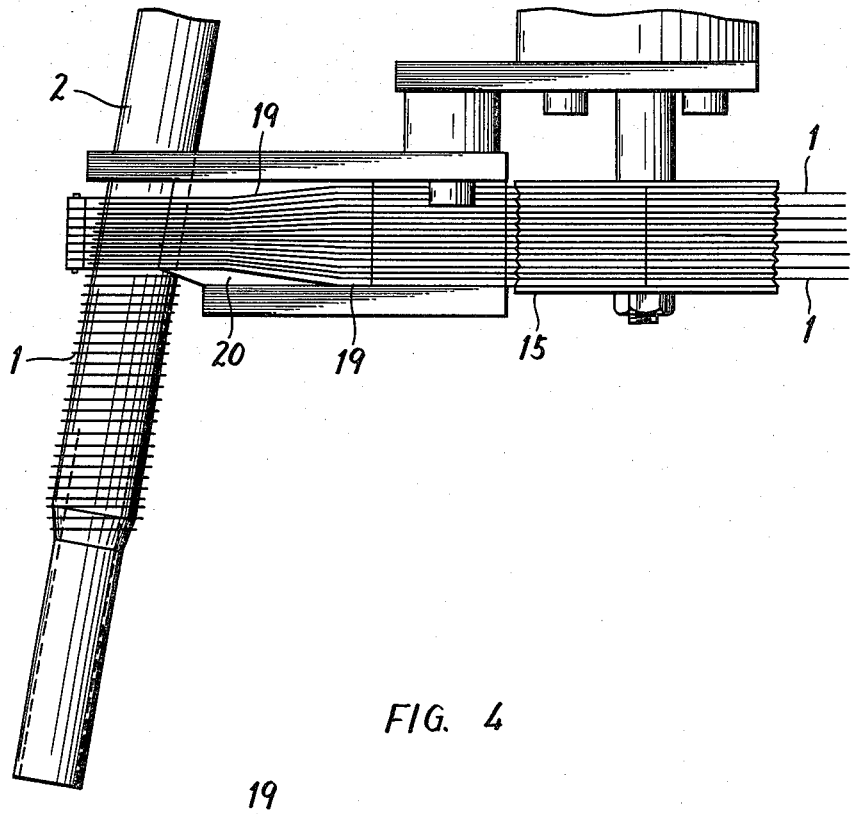
FIG. 3 and FIG. 4 are a plan view and an elevational view respectively of the wire fin delivery station in FIG. 1.
Figure 4:
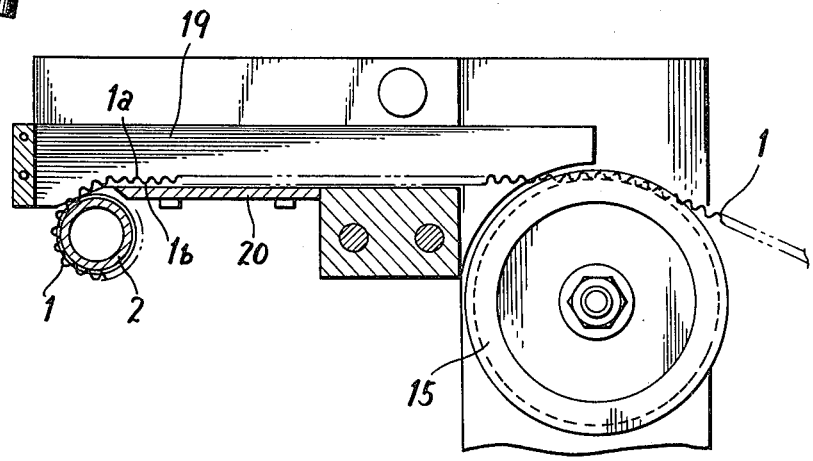
Figure 5:
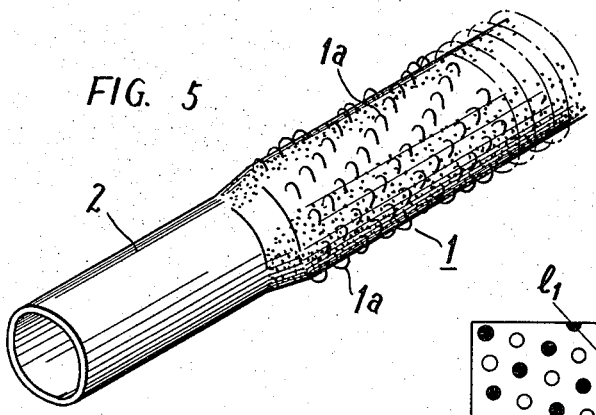
FIG. 5 is a fragmentary perspective view of a finned tube for heat transfer obtained by the invention apparatus.

With reference to FIG. 1 and FIG. 2, the apparatus of this invention is provided with, as essential elements, a wire fin forming station (3), fin guiding means (5), a wire fin delivery station (4), tube feeding means (10) and welding means (11).

The wire fin forming station (3) comprises a grooved roll (12) having a plurality of circumferential grooves, said roll being located at the rear relative to the advancing direction of the wavy wires (1), and a pair of gears (6)(7) in mesh with each other and which are mounted in front of the roll (12). The gears (6)(7) can be driven by means of a motor (M). The roll (12) and the pair of gears (5) and (6) are arranged so that their axes are parallel. The grooved roll (12) has a plurality of annular grooves (12*a*) defined at a suitable pitch on the circumferential surface thereof. The pair of gears (6)(7) are of a construction similar to that of conventional gears for shaping undulating fins. The profiles of the gears conform to the arch-shaped portions (1*a*) and the bottom or trough portions (1*b*) of the wavy wires (1).

When a plurality of wires (W) having a good heat conductivity, for example wires made of a fine rigid copper, payed out from a plurality of wire reels (R), are engaged in the respective annular grooves (12*a*) and are passed through the interdigitated parts of the gears (6)(7) while being maintained in the side-by-side parallel relationship, the fine rigid copper wires (W) are shaped into wavy wires (1) each having alternately recurring arch-shaped portions (1*a*) and trough or bottom portions (1*b*) with the arch-shaped upper portions (1*a*) being upright.

Since a plurality of the wavy wires (1) are thus shaped and obtained simultaneously by passing them through the pair of gears (6)(7), the arch-shaped portions (1*a*) and the trough or bottom portions (1*b*) of the respective wires are naturally in phase with one another and are arranged in lateral alignment.

The wavy wires (1) are transferred, in this state, to the fin guiding means (5).

The fin guiding means (5) comprises a rear grooved roll (13) having a plurality of annular grooves therein that is mounted immediately forwardly of the pair of gears (6)(7), a front grooved roll (15) having a plurality of annular grooves mounted directly rearwardly of the wire fin delivery station (4), an intermediate grooved roll (14) having a plurality of annular grooves mounted so as to be angularly oscillatable upwardly and downwardly by means of an arm (17) pivoted on said front roll (15), and grooved guide rolls (8)(9) supported by the central part of the arm (17).

The intermediate grooved roll (14) is provided so as to be movable towards or away from the plane containing the axes of the rear roll (13) and the front roll (15) while in contact with the wavy wires (1). The grooved roll (14) is, however, ordinarily applied with a resilient force by means of a spring (not shown) mounted on the fulcrum of the arm (17). Thus, as the intermediate grooved roll (14) is oscillated, the grooved guide rolls (8)(9) are also oscillated following the roll (14) in the directions toward or away from said plane.

The grooved guide rolls (8)(9) are pivoted on axles mounted in parallel and horizontal relationship so that they are positioned at different distances from the plane containing the axes of the grooved rolls (13)(15) as shown and are mutually regulatable within a suitable distance to adjust the spacing between the axles.

The reference numeral (16) designates a grooved roll for inhibiting vertical movement of the wavy wires (1) during their travel. A grooved roll (18) which is revolvable about the axis of the rear grooved roll (13) prevents the wavy wires (1) from disengaging from said rear roll (13).

In the fin guiding means (5) thus constructed, a plurality of wavy wires, for example ten wavy wires (1), after passing through the pair of gears (6)(7) are guided, as shown in FIG. 1, via the rear roll (13) in an inclined downward direction to the intermediate roll (14), after which they are transferred in a inclined upward direction to the front roll (15), while being engaged in the respective grooves of the grooved rolls (13), (14), and (15), and are applied with a suitable tension by the spring mounted on the arm (17).

One half of the wavy wires (1), for example the odd-numbered wires, are transferred along a straight path between the front and intermediate grooved rolls (14)(15) while being engaged in the grooves of the guide roll (8), whereas the even-numbered wavy wires (1) are engaged in the grooves of the guide roll (9) and are led to the front roll (15), along a path corresponding to two sides of a triangle of which the bottom side is the travelling path of the aforesaid odd-numbered wires.

Thus, the wavy wires (1) follow two paths of different lengths as they travel from the rear end of the fin guiding means (5), namely, from the grooved roll (13), to the front end of the fin guiding means, namely, to the grooved roll (15), and then are transferred to the wire fin delivery station (4).

This construction of the fin guiding means (5) having two paths of different lengths is an essential feature of this invention.

Next, the construction of the wire fin delivery station (4) will be explained. This device is exposed directly at the front end of the grooved roll (15) of the fin guiding means (5) and comprises mainly a plurality of guide plates (19) arranged in a side-by-side parallel relationship. The guide plates (19) are disposed at intervals of such a distance that the wavy wires (1) can be smoothly passed through the intervals without collapsing. The intervals at the inlet sides of the guide plates (19) conform to the spacings of the grooves of the front roll (15) while the intervals at the outlet sides of the guide plates (19) are diminished to a distance corresponding to a helix pitch as described below. In this way, ten files of the wavy wires (1) that are side-by-side and parallel with one another can be transferred at intervals approaching the required helix pitch, with the arch-shaped portions (1*a*) being in an uncollapsed upright state, and then can be delivered to the winding site.

The guide plates (19) at the wire fin delivery station (4) are formed so that the outlet ends thereof extend over and beyond a position facing the outer surface of a heat transfer tube (2), at which the wire fins are wound around the tube, and the lower ends of the guide plates (19) are attached to a bottom plate (20) so as to avoid having the wavy wires (1) become detached from the guide plates (19).

The tube supply means (10) supplies the heat transfer tube (2) while revolving it about the tube axis as is conventional. The heat transfer tube (2) is fed out in a direction intersecting the vicinity of the front end of the wire fin delivery station (4), crosses obliquely to the advancing direction of the wavy wires (1), and forms right angles relative to the standing direction of the arch-shaped portions (1*a*).

It is possible to adjust the apparatus of the invention so that the winding speed of the wavy wires (1) is equal to or slightly smaller than the feeding speed of the wire fin forming station (3) by determining appropriately the peripheral speed of the heat transfer tube (2).

The welding means (11) is constructed in a conventional manner. For example, where solder is coated on the heat transfer tube (2) a heat oven is installed surrounding the advancing tube. Where a brazing treatment is conducted, a device for flame spraying a welding material is provided facing the advancing tube and a heating device is arranged at the rear of the device.

In FIG. 2, the reference (S) is a switch for actuating or stopping the motor (M) provided with a transmission device which motor serves to rotate the pair of gears (6)(7). The switch serves to detect the oscillation angle of a lever (21) mounted so as to be oscillatable together with the arm (17). When the tension applied to the wavy wires (1) becomes small and the intermediate grooved roll (14) descends to the lower limit position, the switch (S) is turned OFF to stop the motor (M) whereas when the tension becomes large and the intermediate grooved roll (14) ascends up to the upper limit position as shown in FIG. 1 in broken lines, the switch (S) is turned ON to actuate the motor (M). In this way it is possible to automatically regulate the feeding amount of the rigid copper wires (W) so as to agree with the winding amount while maintaining a proper tension force on the wavy wires (1). The switch (s), motor (M), lever (21), arm (17) and grooved roll (14) cooperate to define a tension control means.

In the apparatus described above, the wire fin delivery station (4) will be further described below with respect to its guiding function.

When a plurality of wavy wires (1), for example, ten wavy wires delivered in a side-by-side relationship, are wound around the heat transfer tube (2) as plural helices, a staggered fin configuration can be formed wherein the arch-shaped portions (1*a*) and the trough or bottom portions (1*b*) are in lateral alignment alternately between the odd-numbered wires and the even-numbered wires. This is in contrast to the prior art fin configuration wherein the arch-shaped portions (1*a*) of all the files are in lateral alignment with each other. The odd-numbered wavy wires (1) are transferred through a straight line path linking the grooved rolls (14) and (15) while the even-numbered wavy wires (1) are transferred through the grooved roll (14), guide roll (9) and grooved roll (15) in a bent line path. The difference in path length between the former wires and the latter wires is made equal to ½ the wave pitch (Pw) of the wavy wires.

Referring to FIG. 1, the path length of the former is a line segment linking points of tangency (A)(B), namely $\overline{A-B}=a$ and the path length of the latter is the sum of a line segment linking points of tangency (A)(C), namely $\overline{A-C}=c$ and a line segment linking points of tangency (C)(B), namely $\overline{C-B}=b$.

When the guide roll (9) is located so that the line segment (b) and the line segment (c) are of equal length, and the length of a line taken from the point of tangency (C) to the line segment $\overline{A-B}$ is taken as H, the foregoing staggered fin configuration can be obtained if the following equation is satisfied:

$$(b+c)-a=(m+\tfrac{1}{2})\times Pw \qquad \text{(I)}$$

wherein m is 0 or an integer.

If a=300 mm, Pw=2.5 mm and $b=c=\sqrt{150^2+H^2}$ are substituted, then Equation (I) is represented by:

$$2\times\sqrt{22500+H^2}-300=(m+\tfrac{1}{2})\times 2.5,$$

from which H is calculated by the equation:

$$H=\sqrt{[300+(m+\tfrac{1}{2})\times 2.5]^2/4-22500} \qquad \text{(II)}$$

From Equation (II) above, the results are obtained as shown in the table given below.

| m | 0 | 1 | 2 | 3 | 4 | 5 | 6 |
|---|---|---|---|---|---|---|---|
| H(mm) | 4.33 | 23.79 | 30.78 | 36.49 | 41.46 | 45.93 | 50.04 |

In this table, the example of H=4.33 mm at m=0 is not practical since it is difficult to make a grooved guide roll (9) which has such a small radius so as to be capable of retaining an interval of 4.33 mm.

Figure 6:
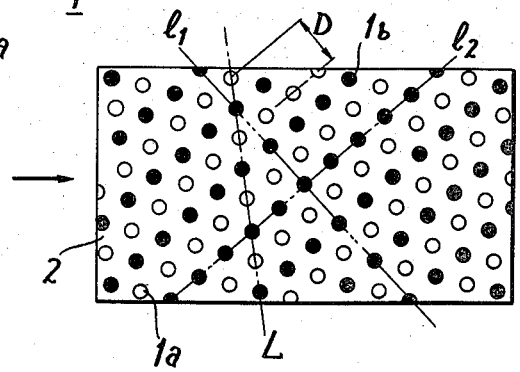
FIG. 6 is an enlarged pattern view of the tube surface of a finned tube obtained according to the invention apparatus.
Figure 7:
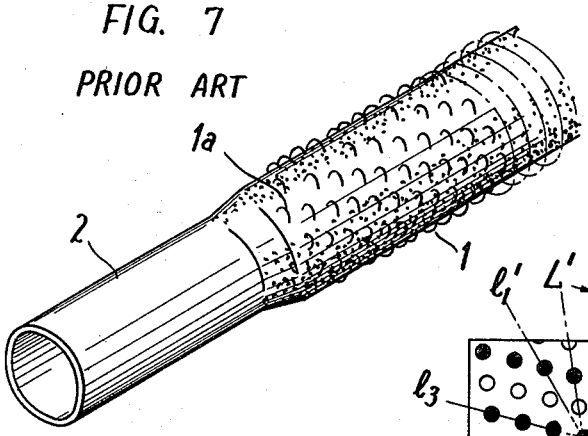
FIG. 7 PRIOR ART
FIG. 7 is a fragmentary perspective view of a prior art finned tube for heat transfer.

For practical purposes, m is preferred to be in the range of 1 to 3. Accordingly, when the guide roll (9) is positioned so that the length of H is maintained to be 24 mm, 31 mm or 36 mm, plural helices of fins can be readily made wherein the arch-shaped portions (1*a*) and the bottom or trough portions (1*b*) are alternately ordered in a side-by-side alignment. FIG. 6 shows an enlarged pattern view showing the state of such a configuration of fins having arch-shaped portions (1*a*) and the trough or bottom portions (1*b*) arranged on the surface of the heat transfer tube (2).

A wire fin tube for heat transfer is produced with the apparatus of this invention described above in the following manner.

To initiate the cycle of operation, the required number of stiff copper wires (W) are fed to the wire fin forming station (3) to be shaped into the wavy wires (1), whose terminal ends are passed through the wire fin guiding means (5) and the wire fin delivery station (4) and are wound around the tube body (2) once or twice. When the motor (M) for driving the gears (6) and (7) and the tube supply means (10) are actuated, the wavy wires (1) shaped continuously between the pair of gears (6) and (7) are delivered by means of the wire fin guiding means (5) and the wire fin delivery station (4) to the surface of the tube body as it advances and revolves with the arch-shaped portions (1*a*) being uncollapsed and upright. Then, the wavy wires (1) are wound helically on the surface of the tube (2) simultaneously with application of an adequate tension. By this process, wire fins in plural helices are formed continuously on the heat transfer tube (2) with the arch-shaped portions (1*a*) being upright on the circumference of the tube and the bottom portions (1*b*) attached flexibly to the tube surface.

The wire fins thus wound are subsequently welded securely to the tube surface by means of the welding means (11) at the bottom portions (1*b*).

After the wire fins are welded to the tube, all of the arch-shaped portions (1*a*) thereof are upright and their initial upright shape is maintained unless an extremely large stress is imposed thereon.

It is possible to regulate the helix pitch easily by appropriately determining the number of wires to be transferred simultaneously and the feeding speed of the tube supply means (10). Moreover, it is possible to conduct orderly fin winding under a constant tension by means of the automatic speed control mechanism controlled by the switch (S).

The fins thus wound constitute a staggered fin configuration wherein the arch-shaped portions (1*a*) and the bottom or trough portions (1*b*) are mutually arranged side by side, without constituting an alignment configuration in which the arch-shaped portions and the bottom portions are each arranged in a side-by-side alignment.

In passing the wavy wires (1) through the fin guiding means (5), various modifications can be made to alter the path length, for example, such as grouping the fin wires into adjacent two halves or at random into two groups or more than three groups, in place of the foregoing embodiment wherein the wires are divided into the odd-numbered wires and the even-numbered wires.

The difference or deviation in the phase of adjacent wavy wires should not be limited to half the length of a wave pitch, but can be altered to a greater or lesser amount than this by appropriately determining the variable (H) relative to the guide roll (9).

As thus far described above, with the apparatus for winding wavy wires (1) as plural helices according to this invention, the fin guiding means (5) is constructed to have at least two different path lengths whereby the wavy wires, afterwards, can be wound around the tube (2) so as to differ in phase between at least two groups of the wires.

Figure 8:
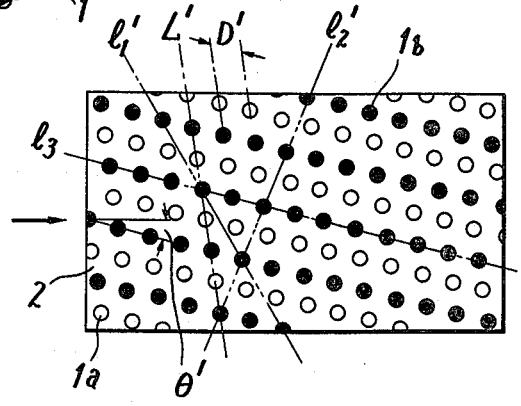
FIG. 8 PRIOR ART
FIG. 8 is an enlarged pattern view of the tube surface of a prior art finned tube for heat transfer.

Hence, adjacent wavy wires are so wound that the bottom portions (1*b*) of one wire are arranged closest to the arch-shaped portions (1*a*) of the next wire, as will be apparent from the comparison between FIG. 6 and FIG. 8. Accordingly, it is possible to make the interval (D) between adjacent arch-shaped portions (1*a*) wider than the interval (D') in the case of the prior art fin tube as shown in FIG. 8. Otherwise, the wavy wires of the invention have the same length of helix pitch and the same total number of the fins per unit length of the tube as the prior art fins have.

Although the interval (D) between the arch-shaped portions can thus be wider, the finned tube of the invention nevertheless is effective in alleviating fluid resistance to a fluid outside the heat transfer tube (2). Therefore, it is advantageous that liquid film is likely to be formed in the portions surrounded by the arch-shaped portions (1*a*). When the finned tube for heat transfer thus constructed is used as an inner tube of a tube-in-tube heat exchanger for an evaporator wherein a refrigerant is passed around the inner tube, evaporation is significantly promoted.

On the other hand, channel passages formed by linking the bottom portions (1*b*) must be considered. The finned tube obtained by means of the apparatus according to this invention is formed with channel passages ($l_1$)($l_2$) (see FIG. 6) in two directions which passages each define a substantial intersecting angle in the direction perpendicular to the winding angle (L) of the wavy wires (1). As a result, the passage area of the channels is small and the resistance to flow of a fluid through them is large, which means that there is little directionality therein. Consequently, the fluid flowing close to the surface of the heat transfer tube (2) is distributed and flowed homogeneously in every direction, so that local flowing does not occur.

By contrast, with the prior art fin tube for heat transfer as shown in FIG. 8, a channel passage ($l_3$) as well as channel passages ($l_1'$)($l_2'$) corresponding to the aforesaid passages ($l_1$) and ($l_2$) are formed. The channel passage ($l_3$) is formed so that the bottom portions (1*b*) are arranged close to one another forming a small intersecting angle to the direction perpendicular to the winding direction (L') of the wavy wires, so that the flow resistance of a fluid is small. This signifies a large directionality of the channel passage ($l_3$), and accordingly, a fluid flowing close to the surface of the heat transfer tube (2) flows preferentially through the channel passage ($l_3$). Therefore, it is unavoidable that local flow occurs.

As will be apparent from the comparison described above, the finned tube for heat transfer obtained by the apparatus of this invention is much enlarged in the contact area between the fluid and the tube surface, which contributes largely to improving the total heat exchange efficiency together with the aforesaid alleviation in fluid resistance.

The wavy wires (1) have a two-dimensional shape wherein the arch-shaped portions (1*a*) and the bottom portions (1*b*) are coplanar and are imparted with an adequate tension upon winding, so that they can be securely wound around the tube surface while in contact with it even if the tube surface is more or less uneven. Accordingly, wavy wires can be wound around a corrugated tube having flutes on the outer surface thereof as well as a smooth tube.

For the wavy wires (1), a small amount of material is used therefor and the cost thereof is inexpensive. Since only the lower bent portions at the ends of the arch-shaped portions (1*a*) are in contact with the tube body (2), the loss in heat transfer area is small with the result that a good efficiency of heat transfer is obtained.

Furthermore, since the arch-shaped portions (1*a*) have a strong "nerve", the fins have high strength and don't collapse, so that it is possible to pile up finned tubes for storage. Moreover, the wires are wound continuously, so that the finned tube can be processed to a bent tube without collapsing the fins.

What is claimed is:

1. An apparatus for producing a finned tube suitable for heat transfer which comprises wire-fin-forming means comprising wire supply means for supplying a plurality of continuous wires having good thermal conductivity, said supply means including a first grooved roll having a plurality of annular grooves in the periphery thereof for receiving and guiding said wires in side-by-side, parallel relationship, and a pair of meshing gears positioned forwardly of said supply means, said gears receiving and passing said wires therebetween in side-by-side parallel relationship and being effective to shape said wires into upright, wavy wires composed of alternating arch-shaped upper portions and trough-shaped bottom portions as said wires are moved forwardly, wire-fin-guiding means positioned forwardly of said pair of gears for guiding forward movement of said wavy wires from said fin-forming means in an upright state and in said side-by-side parallel relationship, said fin-guiding means having at least two different guide paths of different lengths wherein the difference between the path lengths is maintained constant, and means for feeding different groups of said wavy wires in said side-by-side parallel relationship through the respective guide paths so that the respective groups of said wavy wires are moved out of phase with each other, wire-fin-delivery means positioned forwardly of said fin-guiding means for delivering said wavy wires in side-by-side, laterally spaced, parallel relationship with said arch-shaped upper portions being upright, said wire-fin-delivery means including a plurality of guide plates, tube feeding means for feeding a revolving tube across the forward end of said wire-fin-delivery means in a direction transverse to the direction of forward movement of said wavy wires, tension control means for applying tension to said wavy wires so that said wavy wires can be helically wound around the surface of said revolving tube with said trough-shaped bottom portions contacting the tube surface and said arch-shaped portions being flexible and upright thereby to form plural helixes having a helix pitch which is the same as the lateral spacing of said wavy wires at the forward end of said wire-fin-delivery means, and fin welding means for securing said trough-shaped bottom portions of said helically wound wavy wires to the surface of the tube.

2. An apparatus as claimed in claim 1, wherein said fin-guiding means comprises a second grooved roll having a plurality of annular grooves in the periphery thereof, said second grooved roll being disposed forwardly of said wire-fin-forming means, a third grooved roll having a plurality of annular grooves in the periphery thereof, said third grooved roll being disposed rearwardly of said wire-fin-delivery means, a fourth grooved roll having a plurality of annular grooves in the periphery thereof, said fourth grooved roll being disposed between said second and third grooved rolls so as to bear downwardly against the upper sides of said wavy wires as said wavy wires move from said second grooved roll to said third grooved roll, means mounting said fourth grooved roll for oscillation in a direction transverse to a plane containing the axes of rotation of said second and third rolls, and a fifth grooved roll having annular grooves in the periphery thereof, said fifth roll being disposed so as to bear against one group of said wavy wires that extend between said fourth roll and said third roll, said fifth roll being oscillatable together with said fourth roll so as to increase the path length for said one group of wires from said fourth roll to said third roll.

3. An apparatus as claimed in claim 1, wherein said tension control means comprises a fourth grooved roll having a plurality of annular grooves in the periphery thereof, said fourth grooved roll being disposed so as to bear downwardly on said wavy wires travelling forwardly in said fin-guiding means, means mounting said fourth roll for free oscillation in a vertical direction between an upper limit position and a lower limit position, and switch means for detecting the upper limit position and the lower limit position of said fourth roll thereby to start and stop, respectively, rotation of said pair of gears.

4. An apparatus as claimed in claim 1, wherein said fin-guiding means is constructed to provide two guide paths of different lengths, means for feeding one group consisting of alternate ones of said wavy wires through one guide path and means for feeding a second group consisting of the remainder of said wavy wires through the other guide path.

5. An apparatus as claimed in claim 1, wherein said fin-guiding means is constructed to provide two guide paths of different lengths and means for feeding two groups of the wavy wires through the respective guide paths, each group of wavy wires consisting of adjacent wavy wires.

6. An apparatus as claimed in claim 1, wherein said fin-guiding means is constructed to provide two guide paths of different lengths and means for feeding two groups of the wavy wires through the respective guide paths.

7. An apparatus as claimed in claim 4, claim 5 or claim 6, wherein the difference between the path lengths being equal to an integer plus ½ times the length of the distance between adjacent arch-shaped portions of said wavy wires.

* * * * *